US005199892A

United States Patent [19]

Campbell et al.

[11] Patent Number: 5,199,892

[45] Date of Patent: Apr. 6, 1993

[54] CONNECTOR ASSEMBLY AND INFORMATION HANDLING SYSTEM COMPONENT UTILIZING SAME

[75] Inventors: Jeffrey S. Campbell, Endicott; Frederick W. Doolittle; David B. Howe, both of Binghamton; Christopher S. Pendleton, Vestal, all of N.Y.

[73] Assignee: International Business Machines Corporation, Armonk, N.Y.

[21] Appl. No.: 776,940

[22] Filed: Oct. 15, 1991

[51] Int. Cl.[5] ..... H01R 13/64

[52] U.S. Cl. ..... 439/246; 361/413; 361/415

[58] Field of Search ..... 439/246-248; 361/413, 415

[56] References Cited

U.S. PATENT DOCUMENTS

| | | | |
|---|---|---|---|
| 2,721,982 | 10/1955 | Farrington et al. . | |
| 4,522,834 | 6/1985 | Miyahara . | |
| 4,697,859 | 10/1987 | Fisher | 439/246 |
| 4,711,519 | 12/1987 | Smulders . | |
| 4,909,748 | 3/1990 | Kozono et al. . | |
| 4,921,433 | 5/1990 | Biren . | |
| 4,967,311 | 10/1990 | Ferchau et al. . | |
| 4,998,889 | 3/1991 | Moly . | |

FOREIGN PATENT DOCUMENTS 32378 9/1957 Switzerland .

OTHER PUBLICATIONS

IBM Technical Disclosure Bulletin vol. 32, No. 1, Jun. 1989, "Self-Aligning Connector", by Fournier.

*Primary Examiner*—Eugene F. Desmond

*Attorney, Agent, or Firm*—Lawrence R. Fraley

[57] ABSTRACT

A connector assembly for effectively coupling two pairs of connectors wherein one of the pairs is located on a first member, e.g., a chassis, and the second pair is located on a rigid second member, e.g., a slidable card/board structure, adapted for being positioned relative to the first member such that the one pair of connectors on the second member engage the pair on the first member. The receiving connectors are each adapted for movement in response to engagement by the engaging (partner) connectors to thus compensate for possible misalignment of the second connectors. The first of these receiving connectors is movable in two different manners of direction while the second is movable in at least three (and in one embodiment, four) different manners of direction. A component for an information handling system which uses such a connector assembly as part thereof is also provided.

16 Claims, 4 Drawing Sheets

CONNECTOR ASSEMBLY AND INFORMATION HANDLING SYSTEM COMPONENT UTILIZING SAME

TECHNICAL FIELD

The present invention relates to connectors and particularly to connectors of the electrical variety which are usable within components which form part of an information handling system (computer).

BACKGROUND OF THE INVENTION

Various types of many of today's informat handling systems use what are referred to as processors as key elements thereof, many of which are currently manufactured and sold by the assignee of the present invention. In a typical such processor, particularly those referred to as mid-range types, the package structure includes a rack enclosure which functions to encase a plurality of electronic components such as direct access storage devices (DASD's), individual processor units including memory and logic circuit cards and associated board members, etc. Understandably, it is critical in such components that sound, effective electrical connections be achieved between the various elements thereof to assure proper operation of the overall system. It is also considered very important that effective means be provided for separating such connections, e.g., in the event of repair or replacement. One particular such connection which must meet this demanding criteria is between the card and/or associated board members and the corresponding electrical connectors which are to be coupled thereto when the cards and/or boards are fully positioned within the component's overall structure, e.g., rack enclosure.

Heretofore, a typical procedure for providing connections of the above type has been to directly insert a connector on the end of such a card or board into a mating connector located on a base member (a/k/a chassis) which in turn is securedly located within the rack enclosure. To assure effective "docking" (wherein the mating connectors are positively coupled), it is known to provide one of the connectors with some form of motion relative to the other to thereby compensate for possible misalignment due to one or both of the connectors being incorrectly positioned, e.g., as a result of tolerance accumulation during manufacture and/or assembly. Such motion has typically only been in one of two manners of direction, e.g., vertically and horizontally, in a plane perpendicular to the direction of card/board connector insertion. This connection scheme is considered unsatisfactory when attempting to couple associated pairs of selected card/board connectors aligned in substantially fixed alignment relative to each other with corresponding pairs of chassis connectors spacedly located from each other on the chassis. It is desired in some of today's computer components to utilize card and/or board structures wherein the cards and/or boards are fixedly oriented relative to each other to thus form a substantially rigid assembly, and to then locate this assembly, in total, within the receiving chassis and its associated electrical elements, including the aforementioned mating connectors.

As will be defined hereinbelow, the connector assembly of the present invention is capable of providing precise, effective connection between at least two pairs of card/board and associated mating connectors located within/on a chassis of a component, e.g., DASD, which in turn may form part of an information handling system (computer). It is to be understood, however, that the invention defined herein is not limited to such usage, as the invention can also be used to provide effective connections between many various types of connector pairs wherein the connectors in one of the pairs are substantially fixedly located relative to the other and wherein compensation is desired for possible misalignment of one or both of these.

It is believed that such a connector assembly, and an information handling system component using same, would constitute significant advancements in the art.

DISCLOSURE OF THE INVENTION

It is, therefore, a primary object of this invention to enhance the art of electrical connectors by providing a connector assembly which provides for sound, effective electrical coupling between associated pairs of connectors.

It is another object of the invention to provide such an assembly wherein effective compensation is assured for possible misalignment of one or both of the connectors within one of the pairs being joined to the respective, other pair.

It is another object of the invention to provide such a connector assembly which is relatively inexpensive to manufacture and is also relatively easy to operate.

It is yet another object of the invention to provide a component which may form part of an information handling system wherein the component utilizes, and is thereby able to realize, the advantages of such a connector assembly.

In accordance with one object of the invention, there is provided a connector assembly for connecting first and second connectors spacedly positioned on a first member to first and second partner connectors spacedly positioned on a second member when the partner connectors engage the first and second connectors, respectively. The assembly's first connector is positioned on the first member with the second connector being movably positioned on the first member in at least three different manners of direction when engaged by the second partner connector.

In accordance with another embodiment of the invention, there is provided an information handling system component comprising a first member, first and second connectors spacedly located on the first member, a second member for being positioned within the component relative to the first member, and first and second partner connectors for engaging the connectors on the first member when the second member is located (e.g., within the component) relative to the first member. The first of the connectors is positioned on the first member at a first position while the second of the connectors on the first member is movably positioned on the first member in at least three different manners of direction when engaged by the associated, second partner connector.

BEST MODE FOR CARRYING OUT THE INVENTION

For a better understanding of the present invention, together with other and further objects, advantages and capabilities thereof, reference is made to the disclosure and appended claims in connection with the above-described drawings.

Figure 1:
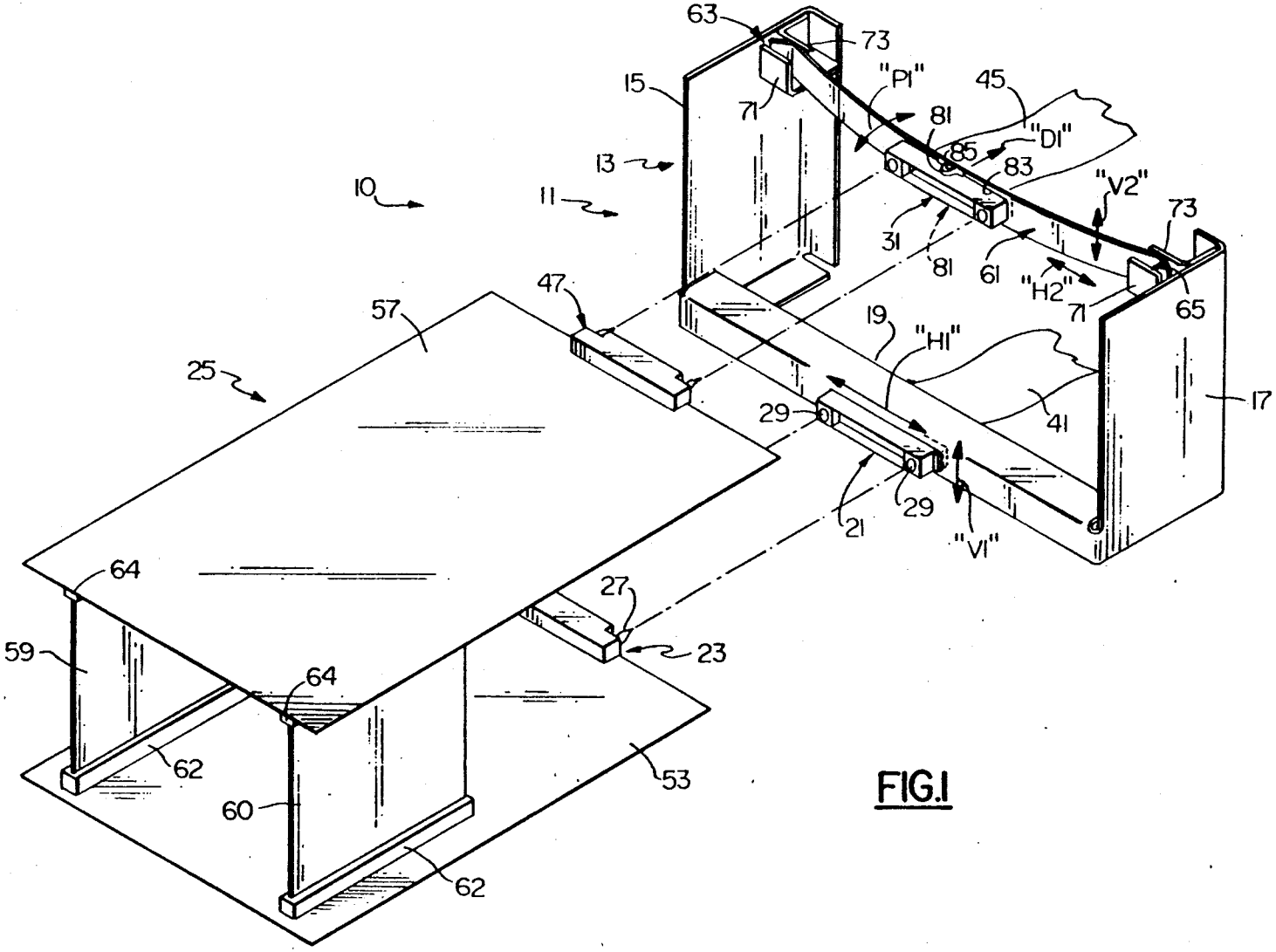
FIG. 1 is a perspective view of a connector assembly in accordance with one embodiment of the invention.

In FIG. 1, there is shown a connector assembly 10 in accordance with a preferred embodiment of the invention. Connector assembly 10, as will be defined herein, is particularly suited for use within a component which may form part of an information handling system (computer). Examples of such components, as stated above, include processor units, DASDs, etc. The present invention will be defined with regard to its use within a DASD. It is understood, however, that the invention is not limited to such usage, nor is the invention limited to computer components.

A DASD component typically is in the form of a drawer or the like for placement within the aforementioned rack enclosure structure (not shown), e.g., to occupy a shelf therein. Understandably, such a rack enclosure will typically further include additional shelves for accommodating other components therein. This drawer structure is not shown in the drawings herein for illustration purposes. It is understood, however, that the various elements defined in the drawings are specifically adapted for being positioned within such a drawer. Further, the DASD drawer structure is electrically coupled to other components within the overall package, as is known, in order to provide the operational capabilities desired for such packages.

In FIG. 1, the invention includes a first member which, if the invention is to be utilized in a DASD component, may also be referred to as a chassis member. As shown, first member 11 comprises a frame 13 which includes a pair of upstanding sides 15 and 17 which project upwardly from an interconnecting leg member 19. Frame 13 is preferably metal, e.g., stainless steel, or alternatively, plastic and is particularly designed for being connected to remaining structural members (not shown) of the DASD. Frame 13 is also preferably of integral construction and formed from a singular piece of metal or, if plastic, molded polymer to the shape illustrated in FIG. 1. When the DASD component is positioned within the described rack enclosure, the upstanding sides 15 and 17 are oriented in a substantially vertical manner (as shown) while the interconnecting leg member, being substantially perpendicular to sides 15 and 17, lies substantially horizontal. Such orientation is not meant to limit the invention however, as it is readily possible to provide connections in accordance with the teachings herein connector members are positioned at other, e.g., diagonal, orientations.

Positioned on leg member 19 is a first connector 21 which is specifically designed for accommodating (receiving) a first partner connector 23, which partner connector 23 is positioned on what will be referred to herein as a second member 25. Further description of this member 25 will be provided hereinbelow. First connector 21 is preferably movably positioned on the longitudinal, interconnecting leg member 19 such that it is able to move in at least two different manners of direction during accommodation of the corresponding partner connector 23. As shown in FIG. 1, connector 21 is able to move vertically (direction "V1") and horizontally (direction "H1") when engaged by connector 23. It is understood that when describing the receiving connectors of the invention (e.g., connectors 21 and 31) as moving in a certain manner of direction (e.g., vertically), that said manner of direction occurs along a singular plane (e.g., vertical) and, more specifically, may be in one of two opposing directions within said plane. Such opposing movements for each such manner of direction are represented by the arrows "H1", "H2", "V1", "V2" and "P1" in FIG. 1, for example. It is also understood that when describing the movement of the upper receiving connector of the invention (connector 31, defined hereinbelow) with respect to its depth relative to the associated partner connector (illustrated as dimension "D1" in FIGS. 1 and 3) that connector 31, being resiliently arranged (e.g., on a spring, also defined hereinbelow) is capable of bidirectional movement as well, along the plane of the depth movement.

In the embodiment of FIG. 1, first connector 21 is shown as a female-type (or receptacle) connector which mates with the corresponding male-type (or plug) connector 23, connector 23 including a pair of protruberance elements 27 thereon (see also FIG. 2) which are each designed for inserting within a corresponding receiving opening 29 in connector 21. Connector 21, by virtue of such dual movement, is thus able to compensate for possible misalignment of connector 23.

Figure 4:
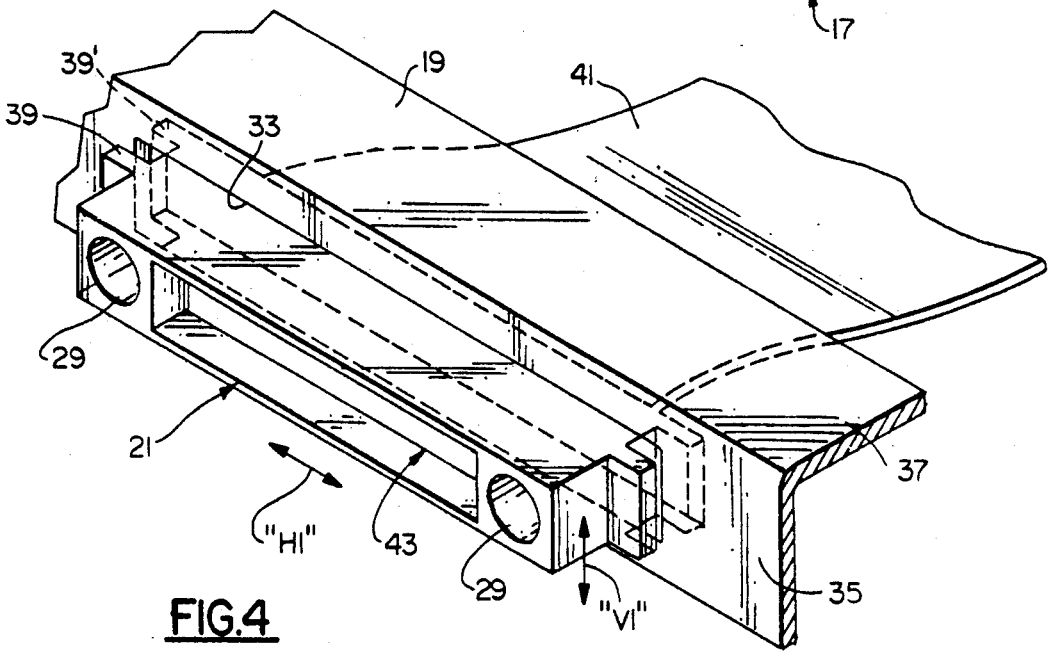
FIG. 4 is a much enlarged partial view of one end of one of the second connectors of the invention in accordance with one embodiment thereof.

As shown in FIG. 4, connector 21 is able to provide the described dual manner of movement by virtue of its placement within an elongated slot 33 within a facing wall section 35 of leg member 19. In FIG. 4, leg member 19 is shown to include two such wall sections, the other denoted by the numeral 37 and lying substantially perpendicular to the facing vertical wall 35. Slot 33, as shown, possesses internal dimensions slightly greater than the corresponding overall outer dimensions of connector 21, and further includes a pair of aligned flange sections 39 and 39' which function to capture the connector housing within wall 35. Flanges 39 and 39' are preferably slightly larger than the corresponding width dimension for slot 33 to thus prevent the main connector housing from falling out of the slot (and thus leg 19).

As further shown in FIG. 4, connector 21 is electrically connected (e.g., using a flexible electrical cable 41) to corresponding circuitry and/or components which also form part of the DASD. It is understood from the drawings that cable 41 is electrically coupled to the connector 21 (and particularly to the several electrical contacts therein) in a manner well known in the art. Use of such flexible cabling in combination with connectors such as those of substantially rectangular configuration as is connector 21, is well known in the art. It is further known that such connectors may include the aforementioned conductive (metallic) contacts therein (not shown) designed for mating with corresponding contacts in the respective partner connector. Further, such contacts may also mate with and be electrically coupled to a substantially planar circuitized member (e.g., board edge) when inserted within the channel (43) formed within the connector's housing should such a member form part of one of the mating connectors in place of (or in addition to) such contacts. Connector 21 (as well as connector 31 defined hereinbelow), as stated, is defined as a female-type connector but this is not meant to limit the invention as it may also serve as a male-type and accomplish the results defined herein. It is further understood that the other connectors defined herein may also include metallic contacts within the corresponding receiving channels thereof, as is known in the art.

Figure 2:
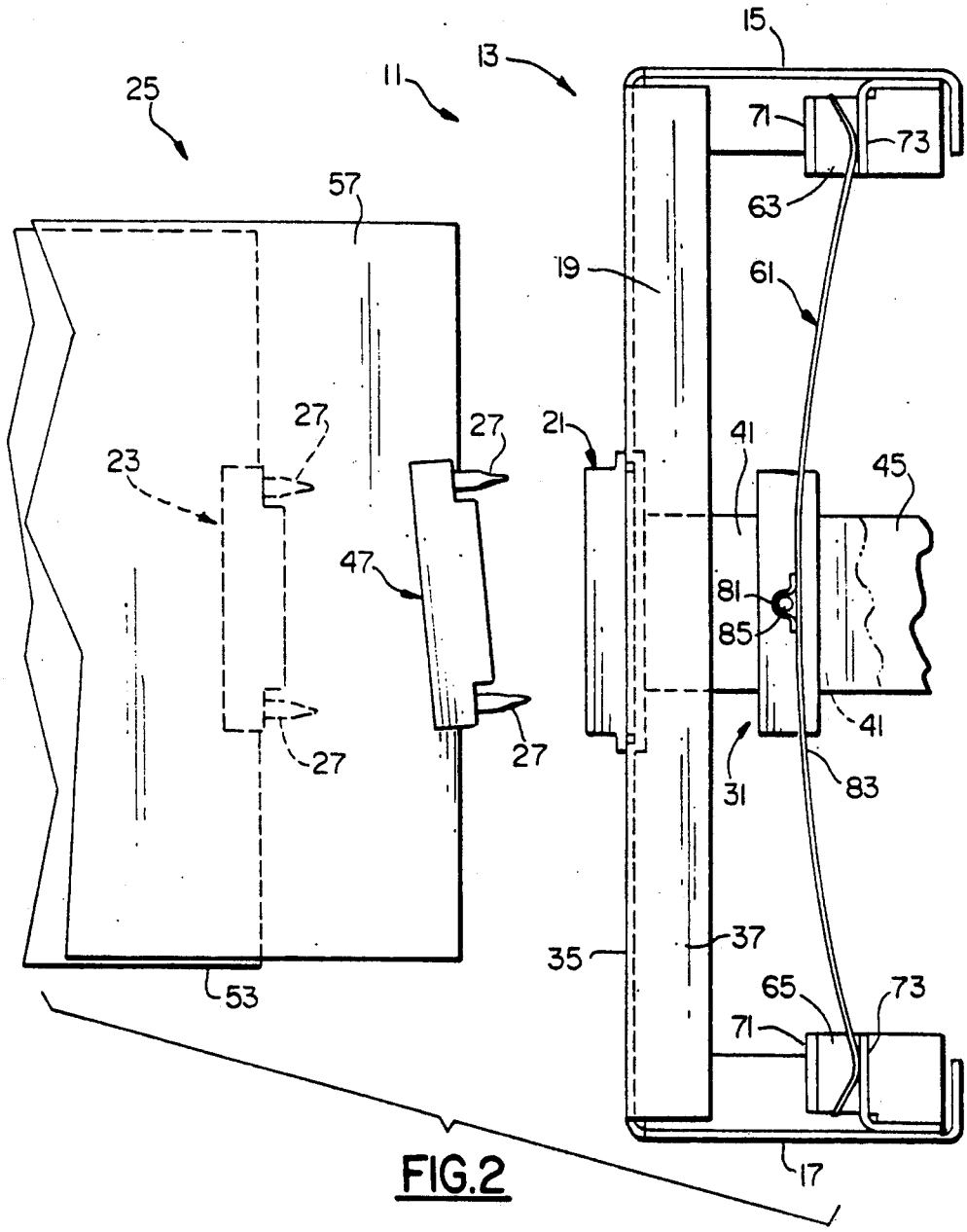
FIG. 2 is an enlarged, top plan view of the connector assembly of FIG. 1 prior to coupling of the connector pairs therein.
Figure 3:
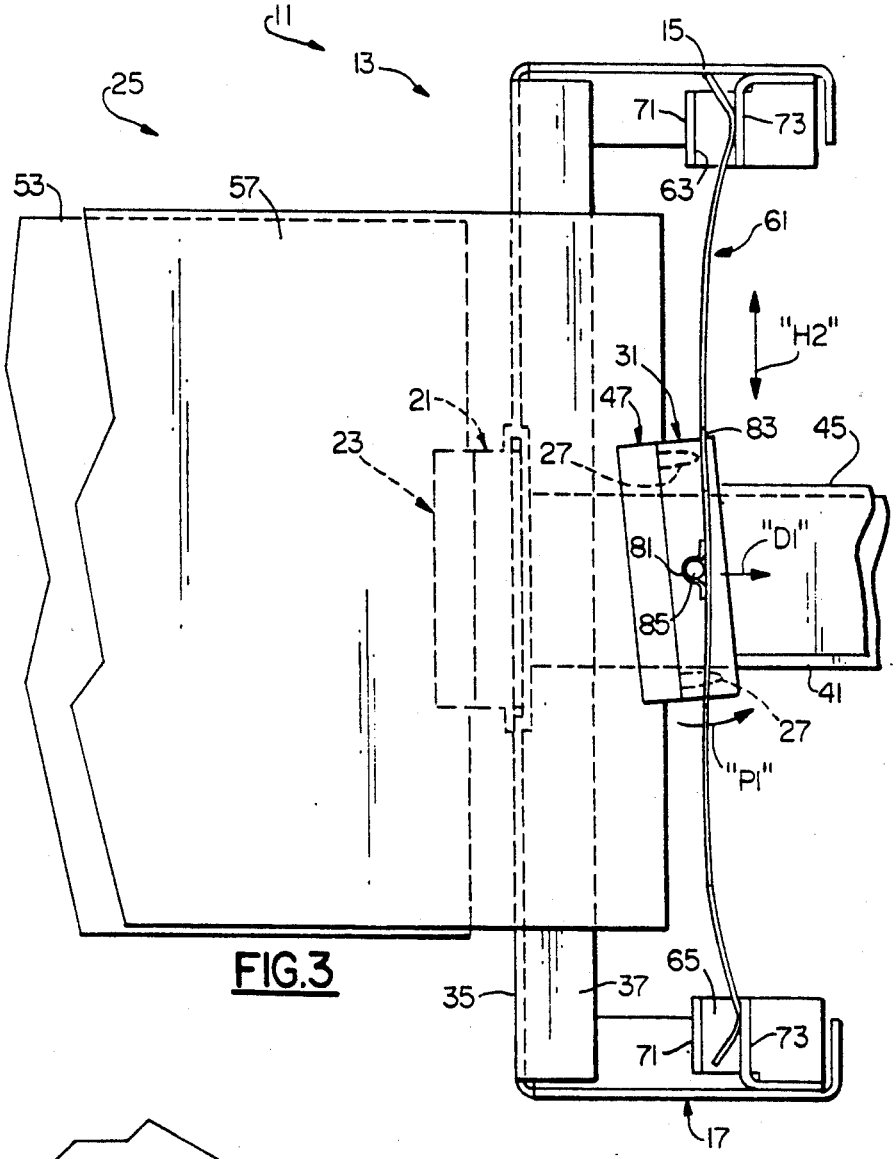
FIG. 3 is an enlarged, top plan view of the connector assembly of FIG. 1 in which the pairs of connectors are coupled.

Second connector 31, as shown in FIGS. 1-3, like the first connector 21, is also electrically coupled to the appropriate circuitry and/or components which form part of the DASD, through its own flexible cable 45, which cable in turn is electrically coupled to the connector similarly to that of cable 41 to connector 21. Significantly, second connector 31 is adapted to moving in at least three different manners of direction, and preferably a fourth, when engaged by a corresponding second partner connector 47 positioned on the second, rigid member 25. The second partner connector 47, preferably a male-type connector as shown in FIG. 1, is designed for engaging the female second connector 31 when rigid member 25 is fully inserted within the DASD drawer and thus relative to (against) the corresponding first member 11. It is understood that second partner connectors 23 and 47 are positioned on the second member 25 so as to be substantially fixedly positioned relative to each other. Further, member 25 is understood to comprise a relatively rigid structure such that relative displacement between both connectors, as well as the other components thereof (defined below), is substantially prevented. In a preferred embodiment of the invention, each connector 23 and 47 is electrically coupled to an end portion of a corresponding circuit board member (53 and 57, respectively) which are substantially parallel to each other, and preferably, are interconnected by a pair of substantially vertically positioned circuit boards 59 and 60. By the term circuit board as used herein is meant to define a layered structure including a dielectric material having at least one conductive plane therein/thereon. Such structures, including those of the multilayered variety (including several conductive planes, which may provide power, ground and/or signal functions), are well known in the art, with examples being defined in U.S. Pat. Nos. 4,916,260, 4,906,198, 4,201,616 and 3,859,711, all of which are assigned to the same assignee as the present invention. Electrically coupling connectors, such as connector 23 and 47, to the end portions of such circuit members is known in the art and may be accomplished in a variety of ways (e.g., soldering, compliant pin or welding). The term circuit board as used herein is meant to include what is also referred to in the art as printed circuit boards, printed wiring boards, circuit cards and the like.

As shown in FIG. 1, boards 59 and 60 are each positioned within a pair of opposing connectors 62 and 64 which in turn are electrically coupled to boards 53 and 57, respectively. The above configuration is not meant to limit the invention, however, in that member 25 may comprise additional elements not described herein for promoting functioning thereof as well as enhancing the structural integrity and rigidity thereof.

Second connector 31, as defined, is capable of moving in at least three manners of direction in response to engagement thereof by the corresponding second partner connector 47. This is considered a significant feature of the invention in that it enables the connectors on frame 13 to uniquely compensate for misalignment of one or both of partner connectors 23 and 47 on the rigid second member 25. Such misalignment may occur as a result of the accumulation of tolerances during manufacture of the various elements of member 25, and/or result from improper positioning of one or both of the connectors (e.g., when coupling same to the respective circuit boards). Such misalignment is shown, in exaggerated form, in FIG. 2 with regard to the second partner connector 47. Additionally, lateral misalignment of both circuit boards 53 and 57 is also shown, again exaggerated, in the plan view of FIG. 2 to represent yet another type of misalignment that the connector assembly of the invention is capable of compensating for. As also understood, the invention is capable of accommodating for forward displacement wherein one of the boards (and coupled partner connector) is located nearer the receiving chassis than originally desired in comparison to the other, corresponding board/connector. It is understood that in the preferred design of the invention, the upper board and associated connector 47 is closer (more forward) than the smaller, lower board 53 and associated connector 23, along the facing (with frame 13) ends thereof.

As shown in FIGS. 1-3, the upper second connector 31 is pivotally secured to a resilient, elongated spring member 61 which is located at the ends thereof within corresponding slots 63 and 65 formed by upstanding flanges 71 and 73 of sides 15 and 17, respectively. That is, each side includes a pair of these extending flanges 71 and 73 which define therein such a channel (63 or 65) in which a protruding end of the elongated spring member 61 is slidably positioned. In such an orientation, the elongated spring, having the connector pivotally secured thereto, is able to move in a lateral manner (horizontally, as indicated by dimension "H2" in FIGS. 1 and 3) as well as in a vertical direction (referenced by the dimension "V2" in FIG. 1) when connector 31 is engaged by the associated partner connector 47. Significantly, connector 31 is also able to pivot about a pivotal location 81 in response to such engagement, such pivotal direction indicated by the arrow "P1" in FIGS. 1 and . Thus, by virtue of being pivotally located on spring 61, connector 31 is capable of readily moving in at least three different manners of direction to compensate for possible misalignment of connector 47 and/or board 57 and/or other elements of second member 25. This rotational movement of the housing of connector 31 is made possible by providing an elongated slot 83 (see also FIG. 6) within the spring, the connector housing thus including a pair of extending pins 85 (only one shown in the drawings) which each fit within a respective pivotal bracket member 81. As shown, these bracket members are secured to spring 61. Although only one such bracket 81 is shown in FIGS. 1-3, 5 and 6, it is clearly understood that two such members are preferably utilized, relative to the upper and lower sides of the housing of connector 31. The lower bracket member not shown is identical to the one depicted herein.

Of further added significance, the second connector 31 is also able to move in yet a fourth (and different) manner of direction to provide even more enhanced accommodation for misalignment of member 25 and/or the elements thereof. This fourth means of compensation is understood to be one of depth relative to the direction of insertion of member 25 against frame member 13. That is, connector 31, being positioned on resilient spring 61, is capable of being deflected backwardly (dimension "D1" in FIGS. 1 and ) when the connector 31 is positively engaged by the associated, partner connector 47. This full engagement, and corresponding deflection of spring 61, is shown in FIG. 3. Additionally, spring 61 is shown as being moved in a horizontal direction ("H2") in FIG. 3 relative to its original position between the upstanding sides 15 and 17 of frame 13. This original position is shown in FIG. 1 2.

In a preferred embodiment of the invention, spring member 61 was comprised of stainless steel and had an overall length of about three inches and a corresponding thickness of from about 0.010 inch to about 0.030 inch, depending on the overall width and spring rate of spring member 61.

In the embodiment as depicted in FIGS. 1-3, it is also possible to provide an added flange member or the like (not shown) to prevent undesired excessive upward movement of spring 61 within the respective end holding slots. Such added retention may also be provided by a corresponding wall or the like of the remaining portions of the DASD structure. Of significance, spring 61 is able to move angularly upward (one side higher than the other) within the slots (63, 65) holding same and thereby provide still further alignment capabilities for the present invention.

Figure 5:
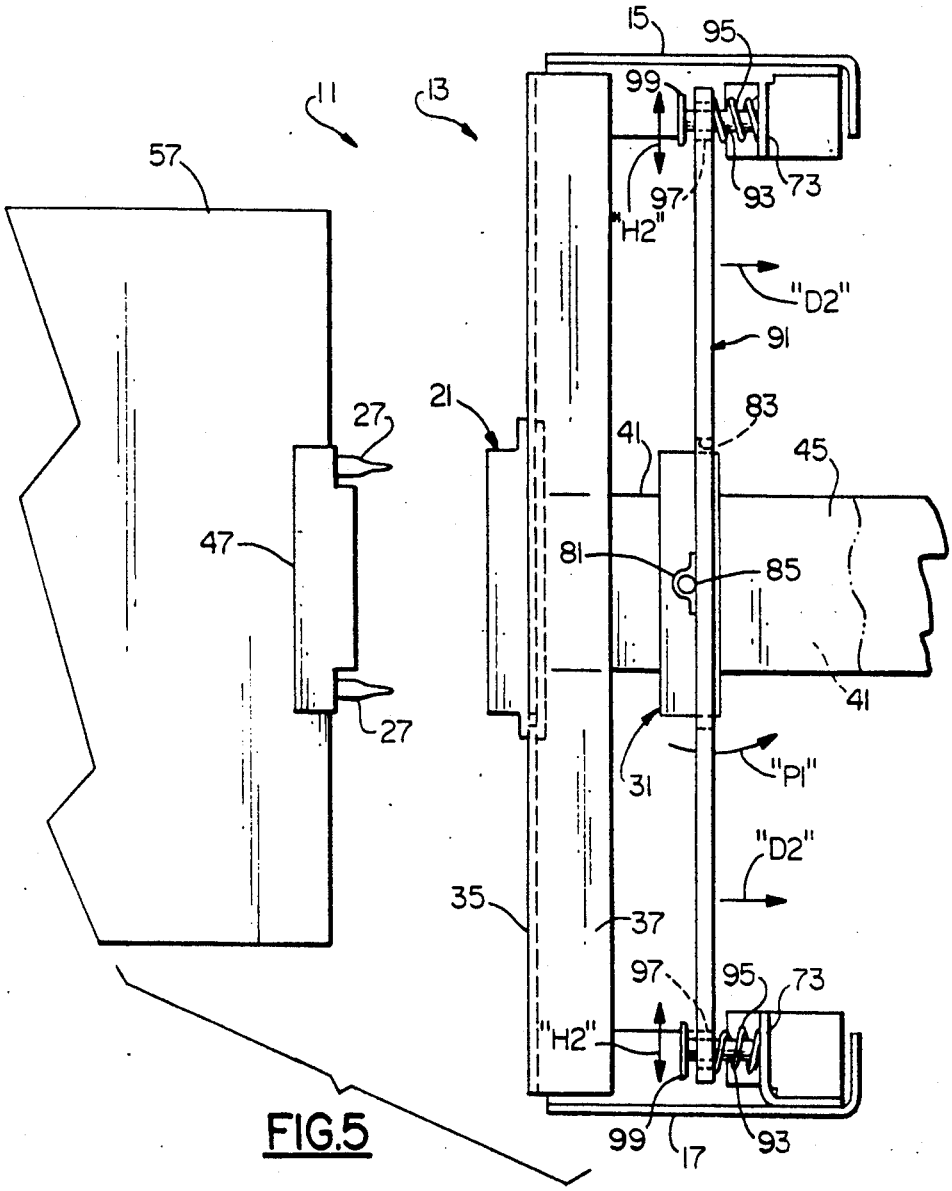
FIG. 5 is an enlarged, top plan view of a connector assembly utilizing a second connector in accordance with another embodiment thereof.
Figure 6:
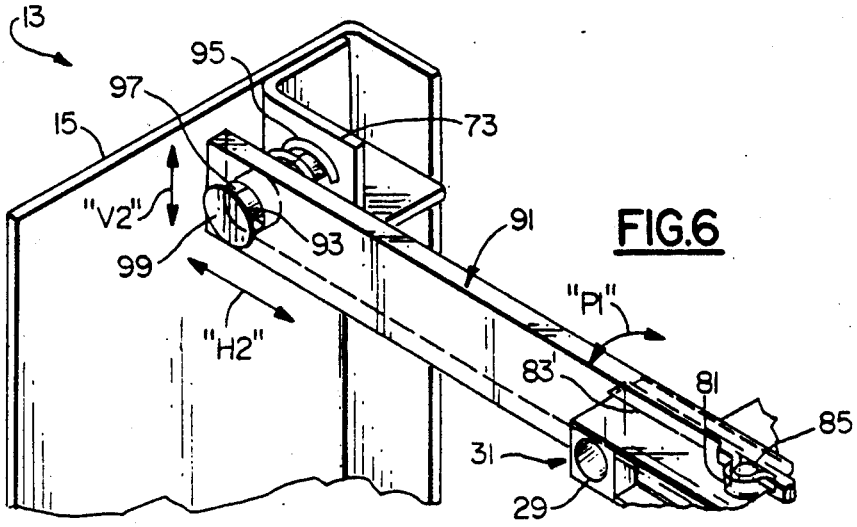
FIG. 6 is a much enlarged partial view of one end of the second connector illustrated in the plan view of FIG. 5.

In FIGS. 5 and 6, there is shown an alternative embodiment of the invention. More particularly, the embodiment of FIGS. 5 and 6 utilizes a different "spring member" from that shown in FIGS. 1-3. This spring member preferably comprises an elongated, substantially rigid bar 91 which extends between upstanding wall members 15 and 17 at substantially the same location as first spring 61. Bar 91 is preferably stainless steel and, in one embodiment, possesses an overall length of about three inches and a corresponding thickness of about 0.150 inch. Bar 19, is secured to a corresponding flange 73 of each wall 15 and 17 through a pin 93 and surrounding coil spring 95 arrangement. Pin 93 is preferably secured (e.g., welded or screwed into) the corresponding flange 73 with the surrounding coil spring 95 or other suitable compressive medium (e.g., foam) located between the flat bar 91 and this flange. An enlarged, more detailed version of one of these arrangements is shown in the perspective view of FIG. 6. Pin 93 is located within a corresponding opening 97 within bar 91, opening 97 being substantially larger than the corresponding outer diameter for the cylindrical pin 93. Pin 93 preferably includes an end cap 99 thereon to provide bar retention.

Engagement of the second partner connector 47 with the first connector 31 in the embodiment of FIGS. 5 and 6 will thus result in bar 91 being rearwardly displaced ("D2") until a full coupling between both connectors is effected. Significantly, bar 91 may also move horizontally ("H2") and vertically ("V2") because of the oversized relationship between the openings 95 and respective pins 93. Notably, the coil spring 95 is also of a substantially larger internal diameter than the corresponding outer diameter for pin 93 about which it is positioned, thereby further assuring this horizontal and vertical displacement. It is also understood that the rearward movement of bar 91 results in compression of the coil springs 95 against the supporting flanges. As also shown in FIGS. 5 and 6, connector 31 is able to pivot ("P1") within the slot 83' provided within bar 91.

The lower connector (23) and associated board (53) are not shown in FIG. 5, for illustration purposes. It is understood, however, that these two members occupy substantially the same positions relative to connector 47 and board 57 in the embodiment of FIGS. 5 and 6 as in the embodiment of FIGS. 1-3. Connector 31 in FIGS. 5 and 6, like connector 31 in FIGS. 1-3, is thus able to move in at least four separate directions when engaged by the corresponding, partner connector 47. This arrangement as depicted in FIGS. 5 and 6 is thus able to provide the enhanced compensation for misalignment to the same extent as the earlier embodiment.

Thus there has been shown and described a new and unique connector assembly for providing enhanced connection between a first pair of connectors and a corresponding pair of partner connectors adapted for being coupled thereto. The invention as defined provides compensation for misalignment (e.g., resulting from excessive tolerances) of the member having one pair of connectors thereon, which connectors serve to engage the receiving pair. Each of the receiving pair is preferably capable of moving in at least two directions, with one of these more preferably movable in at least a third and possibly fourth direction to provide for even further misalignment compensation. The invention as defined is of relatively simple construction and is thus producable at relatively less cost than known connector arrangements.

While there has been shown and described what are at present considered the preferred embodiments of the invention, it will be obvious to those skilled in the art that various changes and modifications may be made therein without departing from the scope of the invention as defined by the appended claims.

What is claimed is:

1. In an electrical connector assembly for electrically connecting first and second connectors spacedly positioned on a first structure including a chassis member for use in an information handling system to first and second partner connectors spacely positioned on a second structure in a substantially fixed relationship relative to each other when said first and second partner connectors engage said first and second connectors, respectively, said second structure including a pair of circuit boards, said first and second partner connectors being electrically coupled to a respective one of said circuit boards, the improvement wherein said first structure includes a spring member as part thereof, said first connector being positioned on said first structure at a first location, said second connector being pivotally positioned on said spring member of said first structure at a second location and movable in at least four different manners of direction when engaged by said second partner connector to thereby compensate for possible misalignment of said connectors.

2. The improvement according to claim 1 wherein said first connector is movable in at least two different manners of direction when engaged by said first partner connector.

3. The improvement according to claim 2 wherein said first connector is movable in both substantially horizontal and vertical manners of direction.

4. The improvement according to claim 3 wherein said second connector is movable in both substantially horizontal and vertical manners of direction and also in a direction substantially away from the direction of movement of said second partner connector when engaging said second connector.

5. The improvement according to claim 1 wherein said chassis member of said first structure comprises a frame including a pair of upstanding sides and a leg member interconnecting said upstanding sides, said first connector being positioned on said leg member.

6. The improvement according to claim 5 wherein said spring member is positioned substantially between said upstanding sides of said frame.

7. The improvement according to claim 6 wherein said spring member is slidably movable in said at least two different manners of direction relative to said upstanding sides of said frame.

8. The improvement according to claim 7 wherein said spring member is deflectable in a direction substantially away from the direction of movement of said second partner connector when engaging said second connector.

9. An information handling system component comprising:

a first structure including a chassis member for use in an information handling system, said first structure further including a spring member as part thereof;

first and second connectors spacedly positioned on said first structure and electrically coupled to the circuitry of said information handling system component;

a second structure for being positioned within said information handling system component relative to said first structure, said second structure including a pair of circuit boards; and first and second partner connectors each spacedly positioned on a respective one of said circuit boards of said second structure and electrically coupled thereto for engaging said first and second connectors on said first structure when said second structure is positioned relative to said first structure, said first connector being positioned on said first structure at a first location and said second connector being pivotally positioned on a spring member of said first structure at a second location and being movable in at least four different manners of direction when engaged by said second partner connector to thereby compensate for possible misalignment of said connectors.

10. The component according to claim 9 wherein said first connector is movable in at least two different manners of direction when engaged by said first partner connector.

11. The component according to claim 10 wherein said first connector is movable in both substantially horizontal and vertical manners of direction.

12. The component according to claim 11 wherein said second connector is movable in both substantially horizontal and vertical manners of direction and also in a direction substantially away from the direction of movement of said second partner connector when engaging said second connector.

13. The component according to claim 9 wherein said chassis member of said first structure comprises a frame including a pair of upstanding sides and a leg member interconnecting said upstanding sides, said first connector being positioned on said leg member.

14. The component according to claim 13 wherein said spring member is positioned substantially between said upstanding sides of said frame.

15. The component according to claim 14 wherein said spring member is slidably movable in said at least two different manners of direction relative to said upstanding sides of said frame.

16. The component according to claim 15 wherein said spring member is deflectable in a direction substantially away from the direction of movement of said second partner when engaging said second connector.

* * * * *